US005438779A

United States Patent [19]

Suarez

[11] Patent Number: 5,438,779

[45] Date of Patent: Aug. 8, 1995

[54] ADVERTISING DISPLAY FOR USE ON SUNSHADES, UMBRELLAS AND THE LIKE

[76] Inventor: Mercedes Suarez, Zabala 3436, (1426) Buenos Aires, Argentina

[21] Appl. No.: 83,452

[22] Filed: Jun. 28, 1993

[30] Foreign Application Priority Data

Jun. 26, 1992 [AR] Argentina ..... 322.644

[51] Int. Cl.[6] ..... G09F 3/00

[52] U.S. Cl. ..... 40/317; 135/16

[58] Field of Search ..... 40/317, 610; 135/16, 135/33.2, 33.7, 91, 93, 117

[56] References Cited

U.S. PATENT DOCUMENTS

| | | | |
|---|---|---|---|
| 162,570 | 4/1875 | Mitchell | 135/33.7 |
| 1,531,622 | 3/1925 | Parsons | 135/93 |
| 2,681,070 | 6/1954 | D'Ippolito | 135/16 |
| 3,404,696 | 10/1968 | De Souza Filho | 135/91 |
| 4,265,261 | 5/1981 | Barker | 135/117 X |
| 5,158,102 | 10/1992 | Lemcke | 135/16 |

*Primary Examiner*—Brian K. Green
*Attorney, Agent, or Firm*—Darby & Darby

[57] ABSTRACT

Advertising display comprising a body forming a display screen which is fixed on the laminar cover of a sunshade, umbrella or the like. Upon closing, the frame of the cover is capable of folding along with the corresponding portion of the display screen, while upon being unfolded, the display screen is positioned vertically.

7 Claims, 1 Drawing Sheet

ADVERTISING DISPLAY FOR USE ON SUNSHADES, UMBRELLAS AND THE LIKE

BACKGROUND OF THE INVENTION—PRIOR ART

The instant invention relates to a novel advertising display to be used on sunshades, umbrellas and the like, characterized by providing a display surface which may be perfectly seen, even from a considerable distance, in spite of the bend and/or slope of the cover of this kind of structures.

Particularly, the advertising display of the invention may be applied to sunshade foldable structures, comprised by an vaulted flexible laminar cover supported on a frame formed by a plurality of rods radially articulated at the end of a bar.

The use of structures of the above-mentioned type as display surfaces is known.

In their most common configuration, such covers, when unfolded, are similar to center planar caps, this being the most suitable resource covering a large surface without impairing people movement around or passing their contour.

However, said conventional configuration is not suitable for using the cover as advertising display since the small slope of said surface loses its shape and prevents the easy reading of the display.

In order to overcome such disadvantages, several means have been developed, for example by modifying the geometrical shape of the cover such that it has an angle closer to the vertical line. Thus, a large variety of geometrical shapes have been developed from the conical or piramidal shape, to more complex ones similar to pagodas, etc.

In other cases, a perimeter skirt is hung from the structure to be used as display screen.

The known embodiments are not effective enough and require an increase in the cover height or modification of the frame folding mechanism, in order that such covers do not impair movement of people.

SUMMARY OF THE INVENTION

The advertising display object of the invention offers the ideal solution to the mentioned problem, since it does not require any modification of the cover shape, is positioned on the cover such that it does not alter the space protected by said cover, provides a display surface which, when the cover is unfolded, is vertically positioned which is optimum for being seen even from distant locations, and is made such that upon folding the cover, said display is automatically folded along therewith without requiring additional space.

In its constructive aspect, the advertising display to be used on sunshades, umbrellas and the like of the instant invention is characterized by comprising a body formed by two flexible laminar parts, a front part bearing a face constituting a display surface and a rear supporting face, such parts being joined only at their perimeter, except the lower edges which are articulated to the foldable laminar cover.

The lower edge of the front part is joined to said cover perpendicularly and centered with respect to the folding axis of a respective portion thereof, limited between two frame rods; while the lower edge of the rear part is joined to the foldable cover such that at least the middle portion of said edge is far from the front part.

Then, the back face of said front part has at least a rigid vertical member fixedly joined thereto, the lower end of which is articulated to the foldable cover and the upper end of which is joined to a pair of reins tractioning said member, which are guided at the joined edges of the two parts, constituting a corresponding means for tensioning said edges, the ends of said reins being fixed to repective points of the foldable cover, positioned forwardly with respect of the lower edge of the front part. A first end of the rein is attached to a second upper end of a rigid rod. A second end of the rein is attached to the foldable cover at a position which is disposed at a greater distance from the first end of a bar then a distance between where a portion of an outer perimeter of the front part is attached to the foldable cover and the first end of the bar.

Other constructive and functional features of the invention will be detailed in the following specification taken along with the accompanying drawings.

BRIEF DESCRIPTION OF THE DRAWINGS

In the figures, the same reference symbols designate the same or corresponding parts.

DETAILED DESCRIPTION OF THE INVENTION

Figure 1:
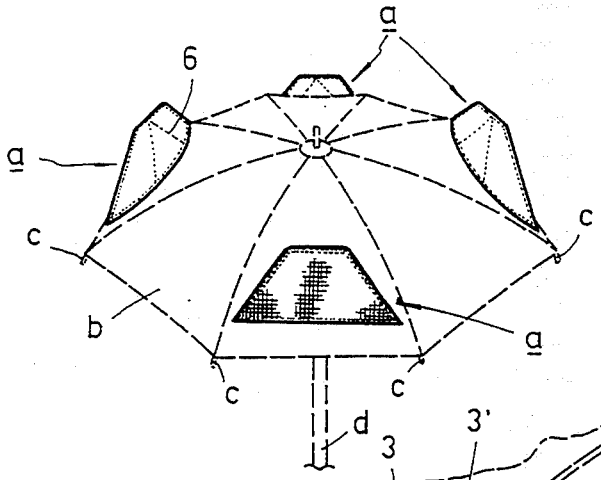
FIG. 1 is a perspective view of a foldable sunshade, umbrella or the like, showing on the cover an arrangement of an advertising display according to the invention.

As clearly shown in the drawings, the advertising display a was created to be applied on the flexible and foldable laminar cover b of a sunshade structure, such as a sunshade per se, an umbrella or the like, particularly of the type in which such cover is vaulted and is supported by a frame comprised by a plurality of rods m radially articulated at the end of a bar d.

The advertising display a comprises a body formed by two flexible laminar parts, a front part 1 and a rear part 2, a pair of sheaths or corresponding casings 7 are sewn into the front laminar part 1.

In accordance with the preferred embodiment, the lower ends of said rigid rods 7 are articulated to the foldable cover b by means of seam 4, while the upper ends are joined by a pair of reins 8 guided within casings 9 parallel and immediate to the joined edges of parts 1 and 2, such casings may be formed by seam 3 and another seam 3 parallel thereto.

The ends of reins 8 are fixed to points of the foldable cover b equidistant from axis e and forwardly with respect to seam 4.

Figure 2:
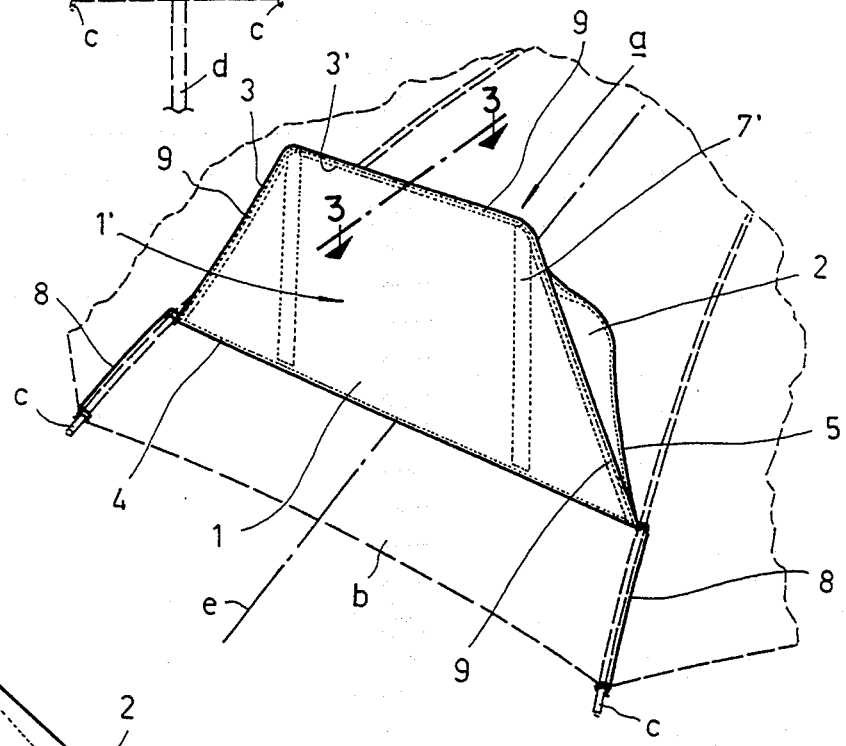
FIG. 2 is a partial enlarged view of the former figure, detailing one of the advertising displays.
Figure 3:
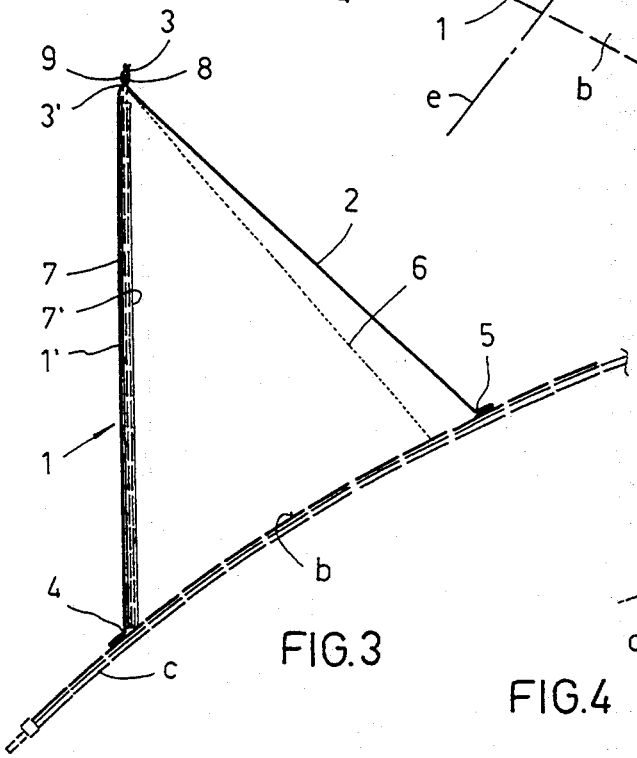
FIG. 3 is a cross section of said support, along line A—A of FIG. 2.
Figure 4:
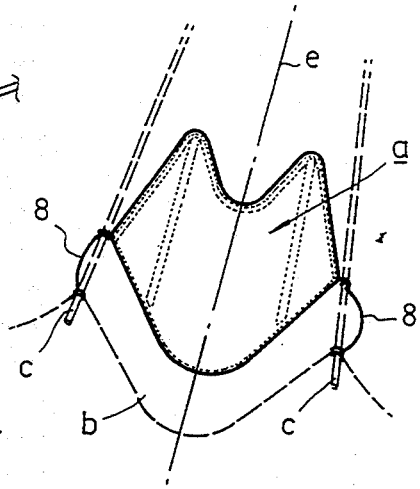
FIG. 4 is a partial perspective view of the display and of the corresponding portion of the foldable cover, both in their folded position.

Preferably, as shown in the drawings (FIG. 2), the distant end portions of reins 8 are guided along rods c of the frame of the sunshade or the like, and fixed at corresponding free ends of said rods.

In this way, when cover b is unfolded, reins 8 act as traction members for rods 7 and, simultaneously, as tensioning elements for the contour of body a, thus being perfectly supported with part 1 and consequently the display surface 1 is positioned vertically. This takes place automatically since reins 8 exert traction on rods 7 and simultaneously tension the contour of body a, this being perfectly supported and with part 1 and, consequently, the display surface 1 is positioned vertically.

These two parts 1 and 2 are joined only at their contour by a seam 3, except the corresponding lower edges which are joined articulatedly by seams 4 and 5, to the foldable cover b.

The lower edge of part 1 and said seam 4 extend perpendicularly and centered with respect to the folding axis e of the corresponding portion of cover b comprised between two-rods c of the sunshade frame.

In turn, the lower edge of the rear part 2 is joined to said cover b by a seam 5 extending at least along a middle portion of said edge, which is far from the lower edge of the front part 1.

Preferably, seam 5 extends along the whole lower edge of part 2 converging towards the lower apexes of part 1. Further, in order to provide a stronger backing, said rear part 2 is slantwise sewn by seams 6. Such arrangement of part 2 aids in the formation of a backing surface offering small resistance to the wind and favors draining of rain water.

On the rear face of the front part 1 there is at least one vertical rigid member 7 fixedly attached within sheath 7'. Preferably there are two of such members 7 disposed equidistant from the folding axis e of the cover b.

When cover b is folded (closed), reins 8 do not exert any traction and the body a folds along with the corresponding portion of said cover b.

I claim:

1. An advertising display comprising:

a bar having a first end and a second end;

a plurality of rods each having a first end and a second end, said first end of said rods being pivotally connected to said first end of said bar, said plurality of rods extending radially from said first end of said bar;

a laminar cover attached to said plurality of rods, said laminar cover having a plurality of folding axes, each of said folding axes being disposed substantially equidistantly between each pair of adjacent rods;

a display including a front laminar part and a rear laminar part, said front part having a front display surface and a rear surface, a portion of an outer perimeter of said front part being attached to said laminar cover, a portion of an outer perimeter of said rear part being attached to said laminar cover, a remaining portion of said outer perimeter of said front part being attached to a remaining portion of said outer perimeter of said rear part;

at least one rigid rod being attached to said rear surface of said front part, said at least one rigid rod having a first lower end and a second upper end, said first lower end being attached to said laminar cover;

at least one rein having a first end and a second end, said first end of said rein being attached to said second upper end of said at least one rigid rod, said second end of said rein being attached to said laminar cover at a position which is disposed at a greater distance from said first end of said bar than a distance between where said portion of said outer perimeter of said from part is attached to said laminar cover and said first end of said bar.

2. An advertising display as claimed in claim 1, wherein there are two vertical rigid rods being disposed equidistant from said folding axis of said laminar cover and between a pair of adjacent rods.

3. An advertising display as claimed in claim 1, wherein said at least one rein is guided in a continuous casing that extends parallel and immediate adjacent to the joined perimeter of the front part and the rear part.

4. An advertising display as claimed in claim 1, wherein said second end of said at least one rein is guided along a corresponding one of said plurality of rods and is fixed to said laminar cover adjacent to a free end of said corresponding one of said plurality of rods.

5. An advertising display as claimed in claim 1, wherein said portion of said outer perimeter of said from part that is attached to said laminar cover is bisected by and is perpendicular to said folding axis, said portion of said outer perimeter of said from part is disposed between a pair of adjacent rods.

6. An advertising display as claimed in claim 1, wherein there are two reins, said second end of said reins are disposed at positions on opposite sides and equidistant from said folding axis.

7. An advertising display as claimed in claim 1, wherein said portion of said outer perimeter of said rear part bisects said folding axis and is spaced from said portion of said outer perimeter of said from part.

* * * * *